US006450081B1

(12) United States Patent
Sorbel

(10) Patent No.: US 6,450,081 B1
(45) Date of Patent: Sep. 17, 2002

(54) HYDRAULIC SYSTEM FOR CONTROLLING AN ATTACHMENT TO A WORK MACHINE SUCH AS THUMB ATTACHMENT USED ON AN EXCAVATOR

(75) Inventor: Dennis L. Sorbel, Maple Park, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/370,540

(22) Filed: Aug. 9, 1999

(51) Int. Cl.[7] ..... F15B 11/08
(52) U.S. Cl. ..... 91/443; 91/461; 91/463
(58) Field of Search ..... 91/433, 443, 446, 91/461, 463, 466, 467

(56) References Cited

U.S. PATENT DOCUMENTS

| | | | | |
|---|---|---|---|---|
| 3,606,049 A | | 9/1971 | Gordon | |
| 3,987,622 A | | 10/1976 | Johnson | |
| 4,147,034 A | | 4/1979 | Johnson | |
| 4,165,613 A | | 8/1979 | Bernhoft et al. | |
| 4,218,837 A | | 8/1980 | Peterman | |
| 4,492,148 A | | 1/1985 | Kuromoto | |
| 4,712,376 A | | 12/1987 | Hadank et al. | |
| 5,005,466 A | * | 4/1991 | Miyaoka | 91/461 X |
| 5,186,000 A | | 2/1993 | Hirata et al. | |
| 5,218,820 A | | 6/1993 | Sepehri et al. | |
| 5,297,381 A | | 3/1994 | Eich et al. | |
| 5,319,933 A | | 6/1994 | Omberg et al. | |
| 5,347,811 A | * | 9/1994 | Hasegawa et al. | 91/461 X |
| 5,813,822 A | | 9/1998 | Pisco | |

* cited by examiner

*Primary Examiner*—John E. Ryznic
(74) *Attorney, Agent, or Firm*—Blackwell Sanders Peper Martin, LLP

(57) ABSTRACT

A hydraulic control circuit for controlling the operation of an attachment or tool associated with a particular work machine wherein such circuit includes an actuator for controlling the operation of the attachment or tool, a control valve operable to control fluid flow to the actuator, a fluid path communicating the control valve with the actuator, and a pilot signal control device positioned in communication with both the control valve and a pilot pressure source and having a signal port in communication with the actuator for sensing the pressure associated therewith, the control device being responsive to the pressure associated with the actuator and being operable for sending a control signal to the control valve when a pressure condition in the actuator reaches a predetermined value, the control signal actuating the control valve so as to at least partially close such valve and maintain an operative pressure on the attachment actuator while, at the same time, decreasing the fluid flow through the control valve. Appropriate pressure reducing valves regulate fluid pressure to the attachment actuator, and regulate the control signal pressure to maintain a predetermined pressure differential between the signal ports of the control valve. This circuit configuration allows the remaining system pressure to be maintained above the maximum allowable attachment actuator pressure to operate other devices and/or functions associated with the work machine.

13 Claims, 2 Drawing Sheets

HYDRAULIC SYSTEM FOR CONTROLLING AN ATTACHMENT TO A WORK MACHINE SUCH AS THUMB ATTACHMENT USED ON AN EXCAVATOR

TECHNICAL FIELD

This invention relates generally to hydraulic control systems used on certain types of work machines for controlling the operation of various attachments or tools which mount to such machines and, more particularly, to a hydraulic control circuit which will sense the pressure to the attachment cylinder or actuator and maintain pressure thereto while allowing the remaining system pressure to remain above the maximum allowable attachment cylinder pressure without necessarily tripping, or at least minimizing fluid flow through, a pressure relief valve associated with the attachment hydraulic circuit.

BACKGROUND ART

In the case of certain types of work machines such as excavators and backhoe loaders, attachments or tools such as a thumb, grapple, rake and the like are often times pivotally mounted to the stick or lift arm assembly so as to enable the work machine to perform other functions and tasks. These attachments or tools are typically mounted to the stick or lift arm assembly by cooperatively engageable mounting means associated with both the lift arm assembly and the particular attachment or tool involved. Typically, one or more hydraulic pumps will be used to operate and drive the various hydraulic cylinders used to actuate and control the lift and/or tilt mechanisms associated with a particular work machine including the cylinders and/or actuators used for operating and driving the particular attachment or tool. Often times, depending upon the particular attachment or tool and the particular application or task being performed by such attachment or tool, the maximum system pressure to operate and drive a particular attachment or tool will be less than the maximum system pressure to operate and drive other functions of the work machine such as the boom and stick arm assembly associated with some work machines.

For example, in the case of a hydraulic excavator, such work machine will typically include a boom which is pivotally moved by a boom cylinder, a stick or lift arm assembly which is pivotally moved by a stick cylinder, and a bucket which is coupled to the stick or lift arm assembly and is pivotally moved by a bucket cylinder. In normal operation, the bucket, arm and boom are pivoted with respect to one another so that the bucket moves towards the excavator to scoop up earth or other material.

Hydraulic excavators are also used to lift heavy objects such as pipes, structural components and the like. When used to perform this secondary lifting function, a counteracting thumb attachment is often times pivotally mounted to the lift arm assembly to accomplish the grasping, holding and lifting function. The thumb attachment, like the thumb on a human hand, works in conjunction with the bucket and allows the excavator to grasp and hold odd-shaped items as well as loose materials. The thumb attachment is operated and driven by a separate hydraulic cylinder and, depending upon the particular linkage associated with the thumb attachment, the thumb is fully retractable to allow normal operation of the bucket and is likewise pivotally rotatable so as to follow the bucket path throughout most of the dump and curl cycle.

Typically, the maximum allowable cylinder pressure to operate and drive the thumb cylinder will be less than other maximum pressures to operate other work devices and/or functions. For example, a typical maximum thumb cylinder pressure is approximately 2500 PSI whereas the maximum system pressure to operate and drive, for example, the stick and boom cylinders is typically approximately 5000 PSI. As a result, the hydraulic circuit associated with the thumb attachment will typically include a pressure relief valve to protect the operation of the thumb cylinder, such pressure relief valve opening at approximately 2500 PSI. Since a hydraulic fluid flow will follow the path of least resistance, the attachments requiring the lowest load pressure are supplied with fluid first. If the pressure relief valve associated with the thumb hydraulic circuit is tripped or opened at 2500 PSI, hydraulic fluid enroute to other work devices and/or functions demanding a higher load pressure will be diverted through the opened pressure relief valve thereby dumping such fluid to tank and providing insufficient fluid flow to the higher load pressure demanding devices and/or functions. When this flow limiting situation occurs, controllability of the particular work devices such as the boom and stick assembly as well as controllability of bucket and swing motion is severely limited and the work machine may stall or incorrectly perform the particular function or application.

It is therefore desirable to provide a hydraulic circuit for controlling an attachment to a particular work machine such as the thumb attachment associated with a hydraulic excavator such that the attachment cylinder or actuator pressure can be maintained within limits at or near the maximum allowed attachment pressure while, at the same time, substantially bypassing and/or limiting fluid flow through the pressure relief valve associated with the attachment circuit such that the system pressure can rise above the maximum allowed attachment pressure to operate and drive other functions of the work machine.

Accordingly, the present invention is directed to overcoming one or more of the problems as set forth above.

DISCLOSURE OF THE INVENTION

In accordance with the teachings of the present invention, a hydraulic circuit for controlling an attachment to a work machine such as thumb attachment used on an excavator is disclosed wherein the hydraulic circuit senses the pressure associated with the attachment cylinder or actuator and when the attachment cylinder pressure reaches a predetermined value, a hydraulic signal is sent to the valve or actuator controlling fluid flow to the attachment cylinder so as to at least partially close such valve thereby maintaining pressure to the attachment cylinder yet substantially limiting fluid flow through the attachment circuit. Since fluid flow through the valve, actuator or other control device that drives the attachment cylinder circuit is substantially reduced, fluid flow through the attachment circuit is minimized thereby allowing the remaining system pressure to remain above the maximum allowed attachment cylinder pressure in order to operate and drive other devices and/or work functions associated with the particular work machine such as the boom, bucket, stick and swing functions of a hydraulic excavator. As a result, the pressure drop in the fluid supplied to the other devices and/or work functions while the attachment circuit is operable will be substantially reduced and the remaining system pressure will be allowed to rise above the maximum allowable pressure to operate the attachment. If the pressure relief valve associated with the attachment circuit is, in fact, tripped or otherwise opened due to the fluid pressure within such circuit reaching a maximum pressure for the attachment cylinder, fluid flow from the remaining system through such pressure relief valve will be minimized since fluid flow through the attachment circuit is minimized. This will not severely limit fluid flow throughout the rest of the system thereby allowing the system pressure to the other devices and/or work functions to remain substantially unchanged.

In order to accomplish this task, the present hydraulic control circuit includes an attachment cylinder or actuator, a signal operated valve or controller for controlling fluid flow to the attachment cylinder, appropriate fluid paths communicating the attachment cylinder or actuator with the signal operated valve or controller, a pilot pressure source, a fluid path communicating the pilot pressure source with the signal operated valve or controller, a pilot signal control device positioned in the fluid path of the pilot pressure source and having a port in communication with the attachment cylinder for sensing the pressure associated therewith, and appropriate pressure reducing valves to both control fluid pressure to the attachment control valve and, under certain operating conditions, to maintain a predetermined pressure differential between the signal ports of the control valve. The valve or controller used for controlling fluid flow to the attachment cylinder is operable between an open position allowing fluid flow to the attachment cylinder and a closed position restricting flow thereto. The pilot signal control device is responsive to the head pressure associated with the attachment cylinder such that when the attachment cylinder head pressure reaches a predetermined valve, a pilot pressure signal is outputted to the signal operated valve or controller to at least partially close such valve thereby locking the attachment in a certain position and maintaining pressure to the attachment cylinder while at the same time minimizing fluid flow both to the attachment cylinder and to the pressure relief valve associated therewith. This circuit configuration maintains the attachment pressure but limits flow thereto thereby permitting the overall system pressure to remain above the maximum allowed attachment cylinder pressure so as to allow other functions associated with the work machine to continue to be available.

Although the present hydraulic circuit will be discussed and explained with respect to controlling a thumb attachment used in conjunction with a bucket on a hydraulic excavator, it is recognized and anticipated that the present hydraulic control system can be incorporated into any work machine to control a wide variety of different attachments or tools in accordance with the teachings of the present invention.

BRIEF DESCRIPTION OF THE DRAWINGS

For a better understanding of the present invention, reference may be made to the accompanying drawings in which.

BEST MODE FOR CARRYING OUT THE INVENTION

For illustrative purposes only, the present hydraulic system or circuit for controlling an attachment to a work machine will be described and disclosed with respect to controlling the operation of a thumb attachment which is manipulated in conjunction with a bucket associated with a hydraulic excavator for allowing the excavator to grasp and hold odd-shaped items as well as loose materials. It is anticipated and recognized that the present hydraulic control circuit may be utilized to operate and control other attachments or tools associated with a wide variety of different types of work machines wherein the attachment tool operates at a lower system pressure as compared to other devices or other functions associated with the particular work machine.

Figure 1:
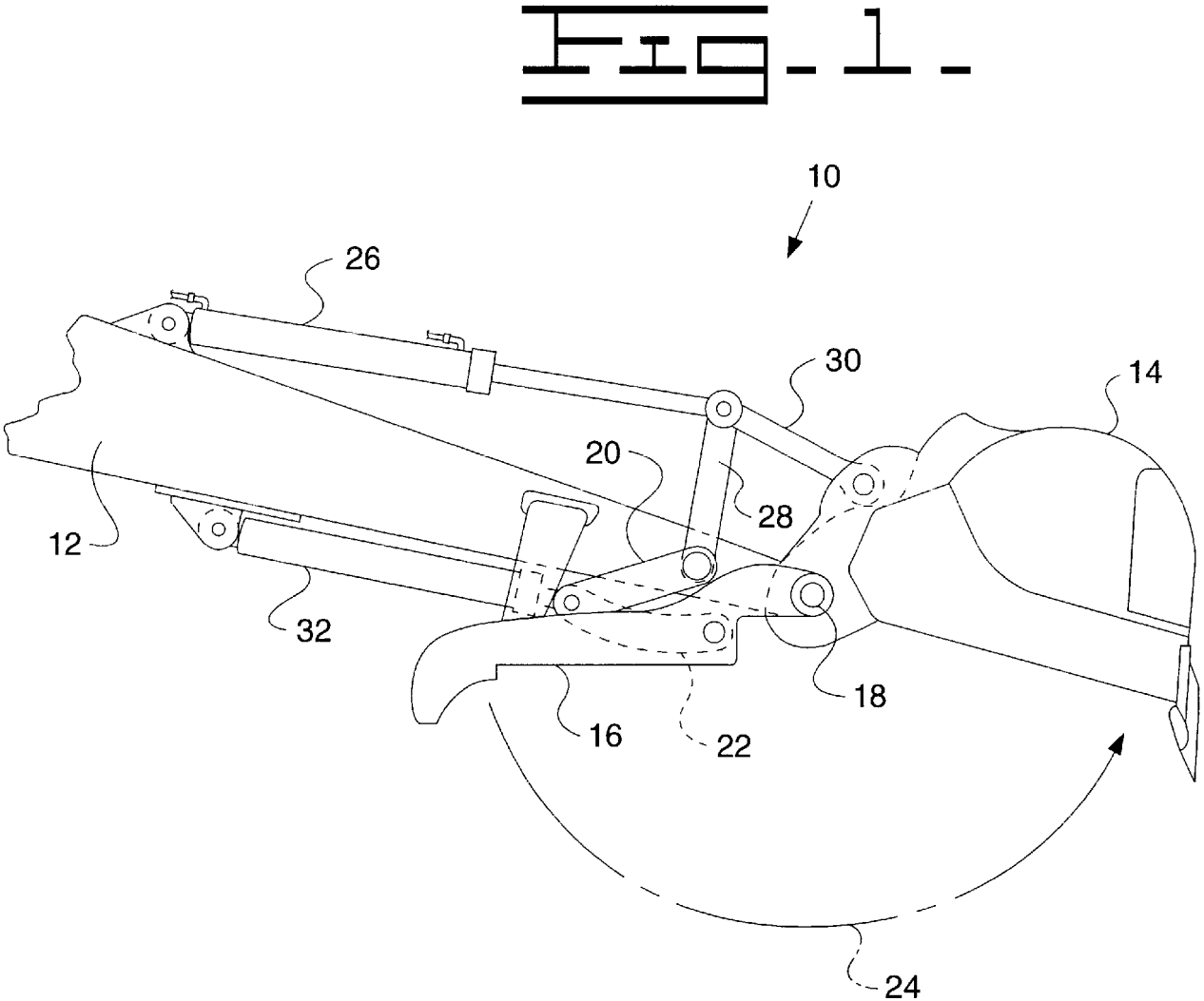
FIG. 1 is a side elevational view of a typical bucket and thumb attachment combination associated with a work machine such as a hydraulic excavator.

Referring to FIG. 1, number 10 represents a typical bucket and thumb combination tool which is removably attachable to one end portion of a stick or lift arm assembly 12 associated with a typical hydraulic excavator. The tool 10 includes an excavator bucket 14 and a thumb attachment 16, both of which articulate with respect to the stick or lift arm assembly 12 as well as with respect to each other by pivoting about a common pivot axis 18. Progressive linkage such as linkage members 20 and 22 connected respectively to the lift arm assembly 12 and to the thumb attachment 16 allow the thumb 16 to move and counter-articulate against the bucket 14 via a common arc 24. In the case of the bucket 14, hydraulic cylinder 26 controls movement of the bucket 14 through the progressive linkage members 28 and 30. In the case of the thumb attachment 16, hydraulic cylinder 32 acts through linkage members 20 and 22 to operate and control movement of the thumb 16.

Thumb attachments such as the attachment 16 are well known in the art and are typically designed to match the excavator bucket for optimum performance. As previously explained, the thumb 16 is mounted to the lift arm assembly 12 at the same point as the bucket 14 thereby allowing the thumb to follow the bucket path during rotation throughout most of the dump and curl cycle. The thumb 16 is shown in its fully retracted position in FIG. 1 wherein the thumb 16 folds in close to the stick or lift arm assembly 12 so as to allow normal operation of the bucket. When activated for use, the thumb 16 acts like the thumb of a human hand and, in combination with the bucket 14, can grasp, hold and lift odd-shaped objects such as pipes and/or structural components. The thumb 16 can also be fully extended and closed against the bucket 14 so as to hold loose materials positioned within the bucket. In this regard, the thumb 16 will typically be dimensioned so as to fit inside the bucket 14 to hold loose materials without jamming, and the thumb 16 will likewise include a plurality of teeth spaced to interlock with the teeth associated with the bucket for holding or sifting loose materials. Other applications and uses of the bucket and thumb combination tool are likewise recognized and anticipated.

Figure 2:
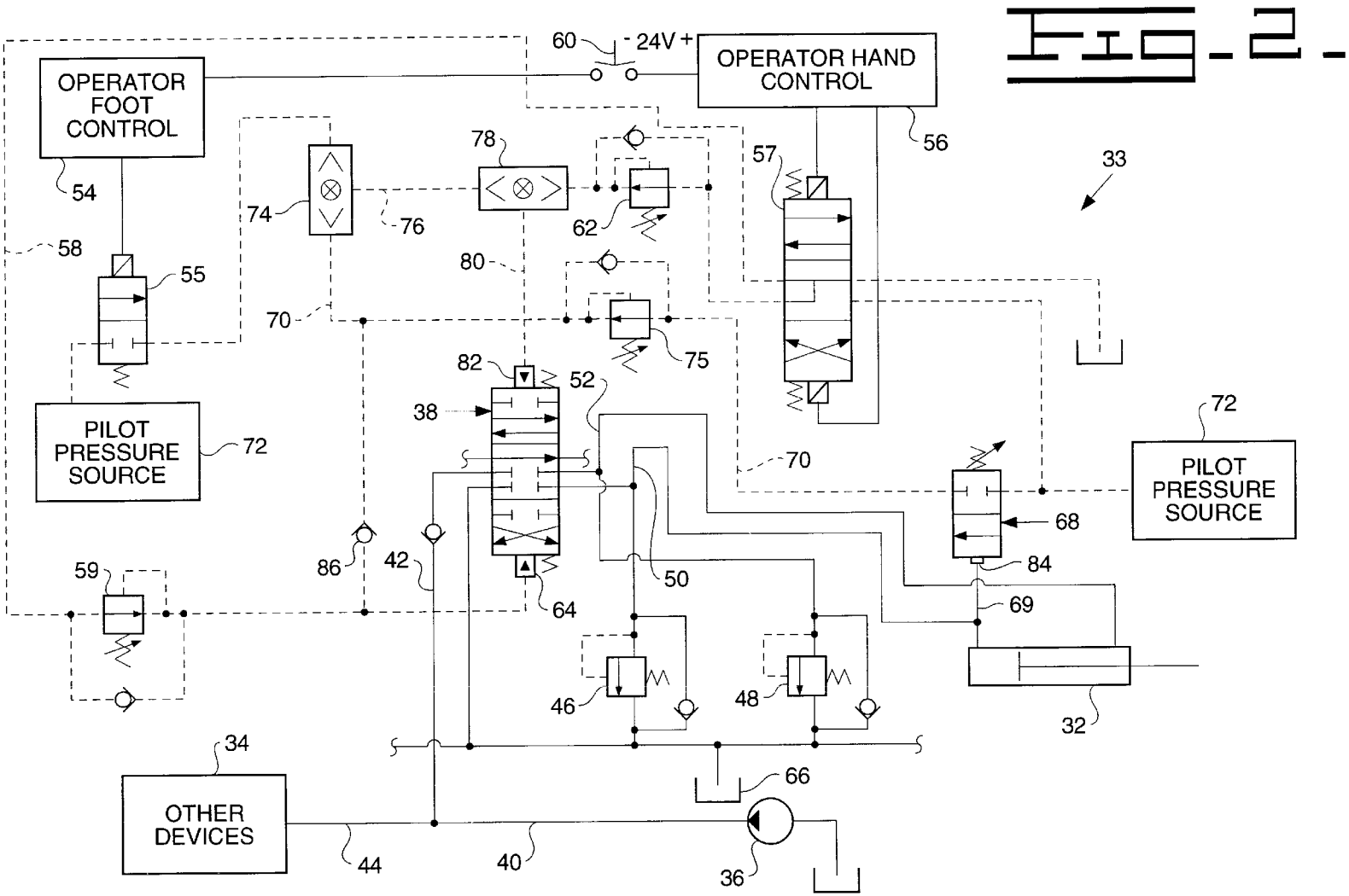
FIG. 2 is a schematic diagram of a hydraulic control circuit constructed in accordance with the teachings of the present invention.

FIG. 2 represents one embodiment 33 of a hydraulic control circuit constructed in accordance with the teachings of the present invention. Hydraulic circuit 33 is specifically used to control and drive the attachment thumb cylinder 32, which attachment cylinder is typically operated at a lower system pressure as compared to other devices 34 associated with a particular work machine such as the lift arm assembly 12 illustrated in FIG. 1. In this regard, a main hydraulic pump 36 such as a fixed displacement pump is utilized to supply hydraulic fluid to various valves and cylinders associated with a particular work machine such as the three position valve 38 which is used to control and drive the thumb cylinder or actuator 32 via fluid paths 40, 42, 50 and 52. Hydraulic pump 36 also supplies fluid flow under pressure to other devices 34 associated with a particular work machine via fluid paths 40 and 44, such other devices including such work functions as boom, arm, bucket and swing functions associated with a particular machine. Although not specifically shown, fluid path 44 would be in communication with other main control valves which would control and drive the other devices 34 illustrate in FIG. 2. Since the maximum system pressure to operate and drive the thumb cylinder 32 will typically be lower than the system pressure needed to operate and drive the other devices 34 such as the lift arm cylinder 26 illustrated in FIG. 1, hydraulic circuit 33 will also include appropriate pressure relief valves such as the pressure relief valves 46 and 48 coupled to fluid paths 50 and 52 as will be hereinafter further explained.

Extension and retraction of the thumb attachment 16 is typically controlled through the use of an operator hand control device 56 such as a hand switch which controls solenoid valve 57. For certain tool operations such as a hammer tool, an operator foot control device 54 such as a foot pedal and an associated solenoid valve such as solenoid valve 55 is commonly used. As a result, many work machines provide means for enabling the operator to choose between use of foot control device 54 or hand control device 56 depending upon the particular attachment tool being utilized. In this regard, as illustrated in FIG. 2, a selector switch 60 is typically used to select between use of foot control device 54 or the hand control device 56. Solenoid valve 55 is a single direction flow device and only allows the foot control device 54 to input a pilot pressure signal to signal port 82. When the foot control device 54 is selected, flow path 50 can be used to control and operate, for example, a hammer tool. The foot control device 54, although illustrated in FIG. 2, is not used to control the operation of the thumb attachment 16. On the other hand, solenoid valve 57 is a two direction flow device and allows the hand control device 56 to input a pilot pressure signal to either signal port 64 or signal port 82.

To extend thumb attachment 16, selector switch 60 must be selected to use the hand control device 56 and solenoid valve 57 must be activated in the proper direction such that a pilot pressure signal is communicated from solenoid valve 57 via fluid path 58 through pressure reducing valve 59 to the pilot signal port 64 associated with the three position control valve 38. When control valve 38 is in its centered position, valve 38 is closed and no fluid flow from pump 36 will be communicated to thumb cylinder 32. When the appropriate pilot pressure signal is received at signal port 64, valve 38 will move to a position represented by the bottom portion of valve 38 in FIG. 2 and fluid flow from pump 36 will be allowed to flow through valve 38 in accordance with the flow path indicated via flow path 50 to the head portion of thumb cylinder 32. This will extend the rod end of cylinder 32 and move thumb attachment 16 towards the bucket 14 along arc 24. Pressure reducing valve 59 adjusts the pressure at signal port 64 to control the amount of valve movement or stem shift in valve 38 which in turn controls the speed of movement of thumb attachment 16. If the fluid pressure in flow path 50 reaches the maximum allowable thumb cylinder pressure, such as, for example, 2500 psi, pressure relief valve 46 positioned in fluid path 50 will open and dump excessive fluid flow to tank 66. In this particular situation, if pressure responsive valve 68 was not positioned and located within circuit 33 as illustrated in FIG. 2, and as will be hereinafter explained, a significant portion of the fluid flow from pump 36 would be dumped through pressure relief valve 46 to tank 66 and flow pressures to the other devices 34 would be severely limited.

If, on the other hand, the operator hand control 56 is utilized to retract the thumb attachment 16, the pilot pressure signal to signal port 64 will be discontinued and a pilot pressure signal to retract thumb cylinder 32 will pass through resolver 74 and 78 and through pressure reducing valve 62 and will be communicated to pilot signal port 82 via flow path 80. In this situation, valve 38 will be moved to a position represented by the top portion of valve 38 in FIG. 2 and the fluid pressure contained in flow path 50 will be dumped to tank 66 thereby reducing the head pressure of thumb cylinder 32 and fluid flow from pump 36 will now pass through valve 38 via flow path 52 to the rod end of thumb cylinder 32 thereby retracting both the cylinder 32 and the thumb attachment 16. Here again, pressure reducing valve 62 likewise adjusts the pressure at signal port 82 to again control the amount of valve movement or stem shift in valve 38 which in turn controls the speed of the thumb attachment 16 as it is retracted. Pressure relief valve 48 is positioned in communication with flow path 52 so as to likewise prevent the fluid flow in flow path 52 from exceeding the maximum allowable thumb cylinder pressure during the retraction phase.

In order to avoid the flow limiting situation caused by the opening of pressure relief valve 46 as explained above when cylinder 32 is fully extended or stalled, a pressure responsive valve or pilot signal control device 68 is coupled to thumb cylinder 32 via flow path 69 and is positioned in fluid flow path 70 communicating a pilot pressure source 72 with resolver 74 and pressure reducing valve 75. Fluid path 70 likewise communicates with pilot signal port 82 associated with control valve 38 via flow paths 76 and 80 and resolver 78. More particularly, control valve 68 has its signal port 84 positioned in communication with the head portion of thumb cylinder 32 for sensing the pressure associated therewith. Control valve 68 is responsive to the head pressure associated with the thumb cylinder 32 such that when the cylinder pressure reaches a predetermined value which is below the maximum allowable thumb cylinder pressure such as, for example, 2150 psi, valve 68 will open and pilot pressure from source 72 is communicated through pressure reducing valve 75 to resolver 74 via flow path 70. Since selector switch 60 must be positioned to allow hand control device 56 to be active, foot control device 54 is inactive and pilot pressure from source 72 will flow through resolver 74 via flow path 76 to resolver 78. Resolver 78 will compare fluid pressure inputs from flow path 76 and from the operator hand control 56 and will resolve such flow pressures via flow path 80 to the pilot signal port 82 of control valve 38. Pressure reducing valve 75 functions to adjust the pressure at signal port 82 as will be hereinafter further explained. If the operator has not already activated an appropriate hand control 56 to retract cylinder 32 and thumb attachment 16, the flow pressure in path 76 from pilot source 72 will control and fluid from pilot source 72 will now also flow via path 80 to the pilot signal port 82.

If the fluid pressure communicated to pilot signal port 82 through resolvers 74 and 78 comes from pilot pressure source 72, the pilot pressure signal to signal port 64 will still be active since flow path 50 is operative to extend thumb cylinder 32. With this in mind, the pilot pressure signal from pilot pressure source 72 is established so as to be slightly less than the pilot pressure signal being communicated to signal port 64 such that valve 38 will begin to move to the center closed position but will remain at least partially open in favor of the valve position represented by the bottom portion of valve 38 due to the pressure differential existing between signal ports 64 and 82. This pressure differential is achieved through the use of pressure reducing valve 75 wherein valve 75 is preset and functions to maintain a pressure differential between signal ports 64 and 82 such as a pressure differential of 175 PSI. This pressure differential favors signal port 64 and will still allow fluid pressure via flow path 50 to the head portion of thumb cylinder 32 sufficient to maintain cylinder 32 extended while only allowing minimum flow through valve 38. Since pressure responsive valve 68 can be set to open at a predetermined value less than the maximum allowable thumb cylinder pressure, the pressure maintained to the thumb cylinder 32 will be at the maximum allowable pressure. Also, since fluid flow through valve 38 is substantially reduced, fluid flow to thumb cylinder 32 and pressure relief valve 46 is minimized thereby allowing pump 36 to continue to provide fluid flow under pressure above the maximum allowable thumb cylinder pressure in order to operate and drive the other devices 34 associated with a particular work machine. Since control valve 38 is only minimally open to keep cylinder 32 extended, the remaining system pressure provided by pump 36 via flow paths 40 and 44 to the other devices 34 can be maintained above the maximum thumb cylinder pressure trapped in flow path 50. If pressure relief valve 46 is tripped for whatever reason, fluid flow from pump 36 via flow path 42 through valve 38 and through pressure relief valve 46 will be minimized since valve 38 is substantially closed and fluid flow therethrough is minimized. As a result, fluid flow throughout the rest of the system such as via flow paths 40 and 44 to the other higher load pressure demanding devices 34 will not be severely limited and flow pressures to such other devices will remain substantially unchanged. Any pressure drop in the fluid being supplied to the other devices 34 will therefore likewise be minimized and any such pressure drops will be substantially reduced.

Once an appropriate operator input control via hand control 56 is initiated to retract the thumb attachment 16, the input pressures from operator control 56 will override any pilot pressure from pilot source 72 at resolvers 74 and 78 and control valve 38 will again be moved to retract thumb cylinder 32. Check valve 86 opens when the fluid pressure at signal port 64 collapses thereby allowing fluid path 70 to drain.

In operation, hydraulic circuit 33 will function to maintain a predetermined attachment cylinder pressure while, at the same time, limiting flow to such cylinder and/or to any pressure relief valve associated therewith thereby permitting the remaining system pressure to remain above the maximum allowable attachment cylinder pressure to operate and drive other devices and functions of the work machine.

INDUSTRIAL APPLICABILITY

As described herein, the present hydraulic system 10 has particular utility in certain types of work machines such as hydraulic excavators for controlling the operation of various attachments or tools which are mounted to such machines as previously explained. This is particularly true where a particular hydraulic circuit controls and drives a plurality of various hydraulic cylinders and/or actuators used to control a plurality of different work devices and/or work functions associated with a particular work machine, and wherein the operating pressures associated with at least one of such work devices and/or functions is less than the operating pressures associated with the other devices and/or functions. Also, importantly, although the present hydraulic circuit 33 has been discussed and explained with respect to controlling the thumb attachment 16 used in conjunction with the bucket 14 illustrated in FIG. 1, it is recognized and anticipated that the hydraulic control system 33 can be incorporated into any work machine to control a wide variety of different attachments or tools in accordance with the teachings of the present invention.

It is also recognized and anticipated that the various pilot signal ports associated with the valves 38 and 68, such as the signal ports 64, 82 and 84 can be electrically actuated as compared to hydraulically actuated. In this situation, appropriate electrical signals would be communicated to the pilot signal ports in order to electrically actuate valves 38 and 68 in accordance with the teachings of the present invention. This could be easily accomplished by coupling the pilot signal ports 64, 82 and 84 to an electronic controller wherein, based upon signal inputs to the controller, the controller would output appropriate signals to appropriate pilot pressure solenoids which would actuate the valves 38 and 68 as described above to control the direction of hydraulic fluid flow therethrough. In similar fashion, operator controls 54 and 56 could likewise be electrically coupled to an electronic controller to input signals from such control devices indicative of extending or retracting the thumb cylinder 32. Solenoid actuated valves are well known in the industry and such solenoids would be used in a conventional manner to control the hydraulic fluid flow through circuit 34.

Electronic controllers or modules are likewise commonly used in association with work machines for accomplishing various tasks. In this regard, such controllers would typically include processing means, such as a microcontroller or microprocessor, associated electronic circuitry such as input/output circuitry, analog circuits or programmed logic arrays, as well as associated memory. An appropriate electronic controller could therefore be programmed to sense and recognize the appropriate signals indicative of the various conditions, states or actuations of the operator hand control 56, as well as sensing the predetermined head pressure associated with thumb cylinder 32, and thereafter output appropriate signals to control the valves 38 and 68. In this regard a wide variety of appropriate sensors could be used to monitor the head pressure associated with thumb cylinder 32.

It is also recognized that variations to the component structure of hydraulic circuit 33 depicted in FIG. 2 could likewise be made without departing from the spirit and scope of the present invention. In particular, components such as valves, actuators and resolvers could be added or some such components could be eliminated. All such variations are intended to be covered by the present invention.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A hydraulic system for controlling operation of an attachment or tool associated with a work machine comprising:

a source of fluid under pressure;

a first fluid operated actuator adapted for connection to the attachment or tool and operable for controlling the operation thereof;

at least one additional second fluid operated actuator adapted for connection to another fluid operated device and operable for controlling the operation thereof wherein the operating pressure of said at least one additional second actuator is greater than the operating pressure of said first actuator;

a signal operated controller connected in fluid communication with the source of fluid under pressure and the fluid operated first actuator, the controller being movable between at least a first position wherein fluid under pressure is allowed to flow from the source of fluid under pressure to the first actuator and a second position wherein said fluid is prevented from flowing to said first actuator;

a pressure sensitive signal control device disposed for sensing a pressure condition in the first actuator and operatively connected to a signal input of the controller, the signal control device being operable to send a signal to the controller operable for moving the controller to a position intermediate said first and second positions for allowing a controlled amount of fluid under pressure to flow to the first actuator when a predetermined pressure level is sensed in the first actuator.

2. The hydraulic system, as set forth in claim 1, including a pressure relief valve disposed in fluid communication with said first actuator and operable for relieving pressure therein when pressure in the first actuator exceeds a second predetermined pressure level greater than the first named predetermined pressure level, said at least one additional second fluid operated actuator having an operating pressure greater than said second predetermined pressure level, a pressure drop in the fluid supplied to said at least one additional second fluid operated actuator being substantially reduced when said controller is moved to a position intermediate said first and second positions.

3. A hydraulic system for controlling the operation of an attachment or tool associated with a work machine comprising:

a source of fluid under pressure;

an actuator for controlling the operation of the attachment or tool;

a signal operated controller connected in fluid communication with the source of fluid under pressure and with said actuator, said controller being movable between at least a first position wherein fluid under pressure is allowed to flow via a first fluid path to operate said actuator in one direction, a second position wherein fluid under pressure is allowed to flow via a second fluid path to operate said actuator in a second direction, and a third position wherein no fluid is allowed to flow to said actuator;

a pilot signal control device positioned in communication with both a pilot pressure source and said signal operated controller and having a signal port in communication with said actuator, said control device being responsive to the pressure associated with said actuator and being operable for sending a control signal to said controller when a pressure condition in said actuator reaches a first predetermined pressure;

a signal path communicating said control device with said controller for inputting a control signal thereto; and a pressure relief valve disposed in communication with said first fluid path and operable to maintain the pressure within said first fluid path below a second predetermined pressure;

said control device outputting a control signal to said signal operated controller when said controller is operable to allow fluid flow to said actuator via said first fluid path and when said first predetermined pressure is reached within said actuator, said control signal being operable to urge said controller towards its third position so as to minimize fluid flow through said pressure relief valve.

4. The hydraulic system, as set forth in claim 3, wherein said signal operated controller is a hydraulically actuated control valve.

5. The hydraulic system, as set forth in claim 3, wherein said pilot signal control device is a hydraulically actuated pressure responsive valve.

6. The hydraulic system, as set forth in claim 3, wherein said signal operated controller is an electronically actuated control valve.

7. The hydraulic system, as set forth in claim 3, wherein said pilot signal control device is an electronically actuated pressure responsive valve.

8. The hydraulic system, as set forth in claim 3, wherein said hydraulic system likewise controls the operation of other work devices and wherein the operating pressure of at least one of said other work devices is greater than the operating pressure of said actuator, said control signal being operable to substantially decrease fluid flow to said first fluid path thereby reducing the pressure drop in the fluid being supplied to said at least one other work device.

9. The hydraulic system, as set forth in claim 3, wherein said signal operated controller includes a pair of signal ports for controlling movement of said controller between its first, second and third positions, said hydraulic system further including a pressure reducing valve positioned in fluid communication with both said control device and said controller for regulating the control signal to said controller, said pressure reducing valve being operable to maintain a predetermined pressure differential between said pair of signal ports.

10. A hydraulic control system comprising at least one hydraulic pump, a plurality of hydraulic actuators for controlling the operation of various work devices associated with a work machine, said actuators being driven by said at least one hydraulic pump, a plurality of flow control valves for controlling fluid flow to said actuators, said plurality of actuators including a first actuator which operates under a first pressure load and a second actuator which operates under a second pressure load, the second pressure load being smaller than the first pressure load, said hydraulic control system further comprising:

a pressure responsive valve positioned in communication with both a pilot pressure source and the flow control valve associated with said second actuator, said pressure responsive valve having a signal port in communication with said second actuator and being responsive to the pressure associated therewith, said pressure responsive valve being operable for sending a control signal to the flow control valve associated with said second actuator when a pressure condition in said second actuator reaches a first predetermined pressure; and a signal path communicating said pressure responsive valve with the flow control valve associated with said second actuator for inputting a control signal thereto;

the flow control valve associated with said second actuator being operable between at least a first position wherein fluid flow under pressure is allowed to flow from the at least one hydraulic pump to said actuator and a second position wherein fluid flow under pressure is prevented from flowing to said second actuator;

said pressure responsive valve outputting a control signal to the flow control valve associated with said second actuator when the flow control valve associated with said second actuator is operable in its first position and when said first predetermined pressure is reached within said second actuator, said control signal being operable to move the flow control valve associated with said second actuator so as to substantially minimize fluid flow therethrough and to substantially minimize the pressure drop in the fluid flow to said first actuator.

11. The hydraulic control system, as set forth in claim 10, including a pressure reducing valve positioned in communication with both said flow control valve associated with said second actuator and said pressure responsive valve, said pressure reducing valve regulating the control signal to the flow control valve associated with said second actuator.

12. A hydraulic system for controlling the operation of an attachment or tool associated with a work machine comprising:

a source of fluid under pressure;

an actuator for controlling the operation of the attachment or tool;

a signal operated controller connected in fluid communication with the source of fluid under pressure and with said actuator, said controller having a pair of signal ports and being movable between at least a first position wherein fluid under pressure is allowed to flow via a first fluid path to operate said actuator in one direction, a second position wherein fluid under pressure is allowed to flow via a second fluid path to operate said actuator in a second direction, and a third position wherein no fluid is allowed to flow to said actuator;

a pilot signal control device positioned in communication with both a pilot pressure source and said signal operated controller and having a signal port in communication with said actuator, said control device being responsive to the pressure associated with said actuator and being operable for sending a control signal to said controller when a pressure condition in said actuator reaches a first predetermined pressure;

a signal path communicating said control device with said controller for inputting a control signal thereto;

a pressure relief valve disposed in communication with said first fluid path and operable to maintain the pressure within said first fluid path below a second predetermined pressure; and a pressure reducing valve positioned in fluid communication with said signal operated controller and with said pilot signal control device for regulating the control signal to said controller;

said control device outputting a control signal to said signal operated controller when said controller is operable to allow fluid flow to said actuator via said first fluid path and when said first predetermined pressure is reached within said actuator, said control signal being operable to urge said controller towards its third position, said pressure reducing valve being operable to maintain a predetermined pressure differential between the pair of signal ports associated with said controller to minimize fluid flow through said controller.

13. The hydraulic system, as set forth in claim 12, including at least one pressure reducing valve positioned in fluid communication with said controller and with said source of fluid under pressure for regulating the fluid pressure to said controller, said at least one pressure reducing valve being operable to adjust the fluid pressure to at least one of said pair of signal ports to control movement of said controller towards at least one of its first, second and third positions.

* * * * *